US006003975A

United States Patent [19]

Desie

[11] Patent Number: 6,003,975

[45] **Date of Patent: *Dec. 21, 1999**

[54] DEP PRINTHEAD STRUCTURE AND PRINTING DEVICE HAVING AN IMPROVED PRINTING ELECTRODE STRUCTURE

[75] Inventor: Guido Desie, Harent, Belgium

[73] Assignee: Agfa-Gevaert N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/679,846

[22] Filed: Jul. 15, 1996

[30] Foreign Application Priority Data

Jul. 14, 1995 [EP] European Pat. Off. ..... 95201939

[51] Int. Cl.[6] ..... B41J 2/06

[52] U.S. Cl. ..... 347/55

[58] Field of Search ..... 347/55, 112, 141, 347/123

[56] References Cited

U.S. PATENT DOCUMENTS

| | | | |
|---|---|---|---|
| 3,689,935 | 9/1972 | Pressman et al. | 347/55 |
| 3,815,145 | 6/1974 | Tisch et al. | 347/123 |
| 4,016,813 | 4/1977 | Pressman et al. | 101/426 |
| 4,491,855 | 1/1985 | Fujii et al. | 347/55 |
| 4,510,509 | 4/1985 | Horike et al. | 347/55 |
| 4,568,955 | 2/1986 | Hosoya et al. | 347/55 |
| 4,679,057 | 7/1987 | Hamada | 347/252 |
| 4,733,256 | 3/1988 | Salmon | 347/55 |
| 4,912,489 | 3/1990 | Schmidlin | 347/55 |
| 5,036,341 | 7/1991 | Larsson | 347/55 |
| 5,038,159 | 8/1991 | Schmidlin et al. | 347/55 |
| 5,121,144 | 6/1992 | Larson et al. | 347/55 |
| 5,221,934 | 6/1993 | Long | 347/55 |
| 5,229,794 | 7/1993 | Honma et al. | 347/55 |
| 5,281,982 | 1/1994 | Mosehauer et al. | 347/55 |
| 5,305,026 | 4/1994 | Kazuo et al. | 347/55 |
| 5,307,092 | 4/1994 | Larson | 347/55 |
| 5,327,169 | 7/1994 | Thompson | 347/55 X |
| 5,402,158 | 3/1995 | Larson | 347/151 |
| 5,497,175 | 3/1996 | Maeda | 347/55 |
| 5,559,541 | 9/1996 | Asanae et al. | 347/55 |
| 5,576,747 | 11/1996 | Sohn | 347/55 |
| 5,576,812 | 11/1996 | Hibino et al. | 399/267 |

FOREIGN PATENT DOCUMENTS

| | | | |
|---|---|---|---|
| 058 013 A3 | 8/1982 | European Pat. Off. . | |
| 0587366 | 9/1993 | European Pat. Off. . | |
| 587366A1 | 3/1994 | European Pat. Off. | 347/55 |
| 0634862 | 1/1995 | European Pat. Off. . | |
| 0675417 | 10/1995 | European Pat. Off. . | |
| 0708386 | 4/1996 | European Pat. Off. . | |
| 0710897 | 5/1996 | European Pat. Off. . | |
| 0715218 | 6/1996 | European Pat. Off. . | |
| 60263962 | of 0000 | Japan . | |
| 4-142952 | 5/1992 | Japan | 347/55 |

*Primary Examiner*—John Barlow
*Assistant Examiner*—C. Dickens
*Attorney, Agent, or Firm*—Baker & Botts, L.L.P.

[57] ABSTRACT

A printhead structure (106) for use in a DEP (Direct Electrostatic Printing) is provided, made from an insulating material comprising a control electrode in combination with printing apertures (107) and being installed between a toner delivery means (101) and a image receiving substrate (109), characterised in that the printhead structure comprises:

(i) one individual control electrode (106*a*) around each aperture (107) on one side of the insulating material (106*d*) of the printhead structure, (ii) one individual shield electrode (106*b*) around each aperture (107) on the other side of the insulating material (106*d*) of the printhead structure, wherein each single electrode of the individual control electrodes (106*a*) and each single electrode of the individual shield electrodes (106*b*) arranged around each aperture (107) are connected to each other via metallisation (106*c*) through the single aperture (107), forming a single printing electrode around each aperture (107).

15 Claims, 2 Drawing Sheets

DEP PRINTHEAD STRUCTURE AND PRINTING DEVICE HAVING AN IMPROVED PRINTING ELECTRODE STRUCTURE

FIELD OF THE INVENTION

This invention relates to a printhead structure useful in an apparatus used in the process of electrostatic printing and more particularly in Direct Electrostatic Printing (DEP). In DEP, electrostatic printing is performed directly from a toner delivery means on an image receiving substrate by means of an electronically addressable printhead structure and the toner has to fly in an imagewise manner towards the image receiving substrate.

BACKGROUND OF THE INVENTION

In DEP (Direct Electrostatic Printing) the toner or developing material is deposited directly in an imagewise way on a image receiving substrate, the latter not bearing any imagewise latent electrostatic image. The substrate can be an intermediate endless flexible belt (e.g. aluminium, polyimide, etc.). In that case the imagewise deposited toner must be transferred onto another final substrate. Preferentially the toner is deposited directly on the final image receiving substrate, thus offering a possibility to create directly the image on the final image receiving substrate, e.g. plain paper, transparency, etc. This deposition step is followed by a final fusing step.

This makes the method different from classical electrography, in which a latent electrostatic image on a charge retentive surface is developed by a suitable material to make the latent image visible. Further on, either the powder image is fused directly to said charge retentive surface, which then results in a direct electrographic print, or the powder image is subsequently transferred to the final substrate and then fused to that medium. The latter process results in an indirect electrographic print. The final substrate may be a transparent medium, opaque polymeric film, paper, etc.

DEP is also markedly different from electrophotography in which an additional step and additional member is introduced to create the latent electrostatic image. More specifically, a photoconductor is used and a charging/exposure cycle is necessary.

A DEP device is disclosed by Pressman in U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode. Hereinafter a printhead structure as describe immediately above will be referred to as "classical" printhead.

Selected potentials are applied to each of the control electrodes, while a fixed potential is applied to the shield electrode. An overall applied propulsion field between a toner delivery means and a support for an image receiving substrate projects charged toner particles through a row of apertures of the printhead structure. The intensity of the particle stream is modulated according to the pattern of potentials applied to the control electrodes. The modulated stream of charged particles impinges upon a image receiving substrate, interposed in the modulated particle stream. The image receiving substrate is transported in a direction orthogonal to the printhead structure, to provide a line-by-line scan printing. The shield electrode may face the toner delivery means and the control electrode may face the image receiving substrate. A DC field is applied between the printhead structure and a single back electrode on the support for the image receiving substrate. This propulsion field is responsible for the attraction of toner to the image receiving substrate that is placed between the printhead structure and the back electrode.

Printing with an engine as described in U.S. Pat. No. 3,689,935 is quite well possible, but shows also some drawbacks. Important drawbacks, that have been addressed in several disclosure are:

- the need for a rather high voltage on the control electrode to close the apertures surrounded by said control electrodes (i.e. to overcome the applied propulsion field),
- expensive electronics for changing the overall density between maximum and minimum density, making the apparatus complex and expensive,
- easy contamination or even clogging of the printing apertures by toner particles.

The drawbacks, mentioned above, result in a poor output quality, especially eveness of the density in solid density areas, and a bad long-time stability if the printing engine is used over several hours.

To overcome these problems several modifications have been proposed in the literature.

In U.S. Pat. No. 4,912,489 the conventional positional order of shield electrode and the control electrode—as described by Pressman—has been reversed (i.e. the shield electrode faces the image image receiving substrate and the control electrodes the toner source). This results in lower voltages needed for tuning the printing density. In a preferred embodiment, this patent discloses a new printhead structure in which the toner particles from the toner delivery means first enter the printhead structure via larger apertures, surrounded by so-called screening electrodes, further pass via smaller apertures, surrounded by control electrodes and leave the structure via a shield electrode.

In EP-A-0 587 366 an apparatus is described in which the distance between printhead structure and toner delivery means is made very small by using a scratching contact. As a result, the voltage needed on the control electrodes to close the apertures surrounded by said control electrodes (i.e. to overcome the applied propulsion field) is very small. The scratching contact, however, demands a very abrasion resistant top layer on the printhead structure.

An apparatus working at very close distance between the printhead structure and the toner delivery means is also described in U.S. Pat. No. 5,281,982. Here a fixed but very small gap is created in a rigid configuration, making it possible to use a rather low voltage to select wanted packets of toner particles. However, the rigid configuration requires special electrodes in the printhead structure and circuits to provide toner migration via traveling waves.

In U.S. Pat. No. 4,568,955 e.g. a segmented support for an image receiving substrate, comprising different galvanically isolated styli as control back electrodes is used in combination with toner particles that are migrated with travelling electrostatic waves. The printing can proceed with lower voltage, but resolution is limited and the image quality depends quite strongly on both the environmental conditions and properties of the image receiving substrate.

In U.S. Pat. No. 4,733,256 some of the problems cited above are addressed by the combination of a "classical" printhead structure, i.e. a printhead structure as described in U.S. Pat. No. 3,689,935, and a segmented back electrode (control back electrode), comprising different isolated wires and carrying the image receiving member. For a line printer the density can be tuned by selecting an appropriate voltage for shield electrode, control electrode and control back electrode wire.

In U.S. Pat. No. 5,036,341 a device is described comprising a screen- or lattice shaped control back electrode matrix as segmented support for an image receiving substrate. This apparatus has the advantage that matrix-wide image information can be written to the image receiving substrate, but it also suffers from the environmental influences and those caused by the nature of the image receiving substrate.

To overcome these drawbacks in U.S. Pat. No. 5,121,144 another device wherein the segmented back electrode without printhead structure was changed into a two part electrode system, having a printhead structure electrode and a back electrode structure. A first part was placed between the toner delivery means and the image receiving substrate and consisted of parallel, isolated wires, being used as printhead structure. A second part consisted of another set of parallel wires, arranged orthogonally with respect to the first wires and was used as back electrode structure. The support for the image receiving substrate or back electrode structure in all examples consists of isolated wires which are oriented in one direction. As printhead structure, there are described three different configurations:

1. isolated wires in a cross direction;
2. a flexible PCB with only control electrodes in the cross direction and
3. a flexible PCB with common shield electrode and control electrodes in the cross direction. The different systems according to this disclosure make it possible to change the propulsion field in a group of apertures, tuning the density by setting the voltage of the different control electrodes, and require only moderate printing voltages.

In U.S. Pat. No. 5,402,158 the above indicated printhead structure 2 (namely a flexible PCB with individually controllable control electrodes without shield electrode) is also used in combination with a non-segmented ("classical") back electrode. This printhead structure, however, has the disadvantage that frictional charging can occur leading to image instabilities for long-term printouts.

This last disadvantage has been partially overcome, as described in U.S. Pat. No. 5,307,092, by the application of a grounded antistatic overcoat over said single-plane-electrode printhead structure, i.e. in stead of using a metal conductor as shield electrode, an antistatic layer is used.

According to U.S. Pat. No. 4,491,855 the image density can be enhanced by the introduction of an AC-voltage, applied to the toner conveying member. As a result, shorter writing times are possible. But, to obtain a reduced image density, the quite elevated voltage levels must be applied.

In U.S. Pat. No. 5,229,794 and the EP-Application 710 897 a printhead structure with individually controllable control electrodes and shield electrodes around every aperture is described. These printhead structures have the advantage that accurate control over potential values at the outer surfaces of the printhead structure are possible, but the electronics needed to drive such a complex printhead structure make a device making use of said printhead structure quite complex and expensive.

The disclosures mentioned above, do solve some of the problems present in the original DEP (Direct Electrostatic Printing) device, but in general the combination of low voltage addressable printing apertures combined with low contamination just fulfil one or a few of the different requirements for an inexpensive DEP device, delivering high-quality images with stable densities.

There is thus still a need to have a DEP system, based on a simple apparatus, yielding high quality images in a reproducible and constant way.

SUMMARY OF THE INVENTION

It is an object of the invention to realise a printhead structure for use in DEP wherein printing can proceed with lower voltage applied to the control electrodes on said printhead structure.

It is a further object of the invention to realise a printhead structure for use in DEP that makes it possible to print with a good long term stability with constant image density without clogging of the apertures.

It is an object of the invention to provide an improved Direct Electrostatic Printing (DEP) device, incorporating an improved printhead structure, printing high quality images.

Further objects and advantages of the invention will become clear from the description hereinafter.

DETAILED DESCRIPTION OF THE INVENTION

In the literature many devices have been described that operate according to the principles of DEP (Direct Electrographic Printing). However, with all these devices it is very difficult to obtain long-term stability with constant image densities and no clogging of the apertures. The printhead structure according to the present invention is a modification of the "classical" three-layered structure as described by Pressman in U.S. Pat. No. 3,689,935. In that disclosure segmented control electrodes around printing apertures on one side of an insulating layer and a continuous electrode an the other side of said insulating layer is disclosed. The modification, according to the present invention, of such a printhead structure, consists in the presence of an individual control electrode (106*a*) around each printing aperture on one side of the insulating material (106*d*) and the presence of an individual shield electrode (106*b*) around each individual printing aperture on the other side of the insulating material (106*d*) and in the fact that both electrodes (106*a*) and (106*b*) are short circuited (connected to each other) by a metallizaton 106*c* through the aperture.

Figure 1:
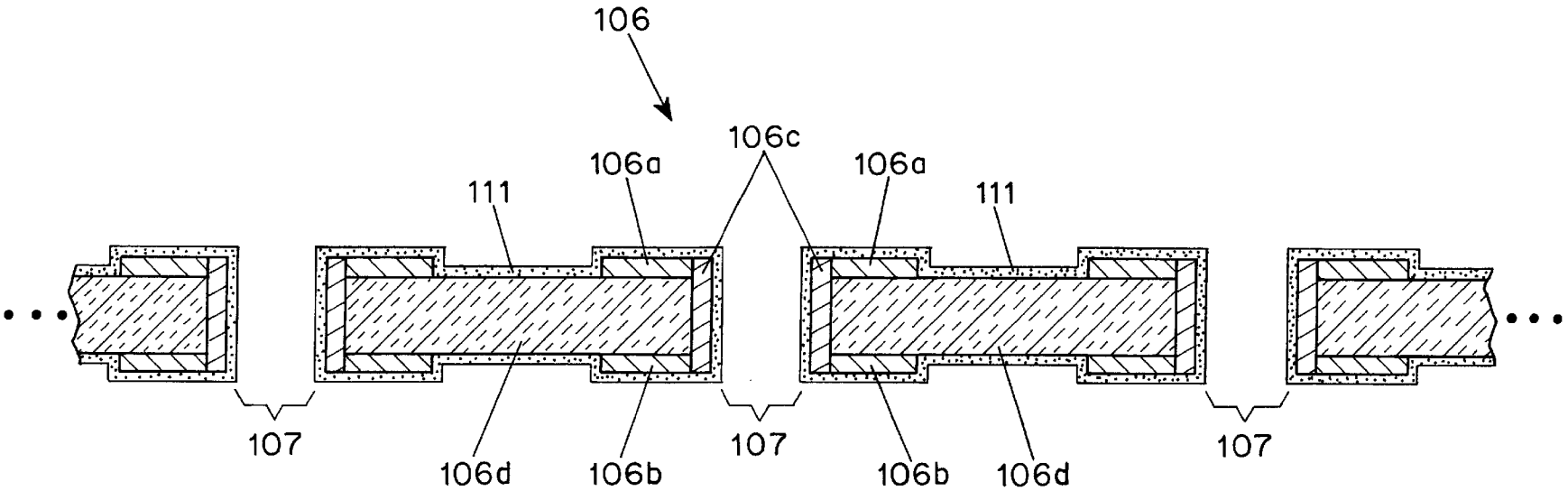
FIG. 1 is a schematic cross-section through one printing aperture incorporated in a printhead structure according to the present invention.

In FIG. 1 a schematic cross-section through one aperture of a printhead structure according to the present invention is shown. It shows the insulating material (106*d*), wherein aperture (107) is present. Around aperture (107) an individual control electrode (106*a*) is present at one side of the insulating material and an individual shield electrode (106*b*) on the other side of the insulating material. Both electrodes are connected to each other by a metallization (through hole connection) (106*c*) through aperture (107).

In the construction, according to this invention, there is no insulating material at top of the surface through which the individual toner particles are moving. From an electrical point of view it is possible with a printhead structure of the present invention to create a well defined electric field between the toner supplying member (e.g. the surface of a charged toner conveyor in one embodiment of the present invention) and the front side of said printhead structure, and between the back side of said printhead structure and the back electrode, while there is no electric field over the thickness of said printhead structure.

In other, prior art, constructions of printhead structures, where control and shield electrode are isolated from each other, one of the causes of bad image quality is that the insulation between both electrodes can accidentaly, during the lifetime of the device, be disrupted around some of the printing apertures, that then become short circuited. Thus with "classical" printhead structures the risk exist that, during the lifetime, the electrical behaviour of all printing apertures is no longer equal to each other and that thus after a longer printing time the printed image can get unwanted density fluctuations in even density areas (banding), or have lines of lower or higher densities produced by printing apertures that allow less or more toner to pass. It is even possible, in "classical" printheads that some printing apertures become, during lifetime due to accidental short-circuiting, totally inoperative and remain either open or closed.

A specific embodiment of a printhead structure according to the present invention is made from polyimide isolating film on both sides coated with a copper layer. The manufacture of a printhead structure can proceed as follows: First of all the printing apertures are made in the copper electrodes via copper etching techniques and then the apertures are also made through said isolating film by excimer laser burning. Then the ring electrodes are made on both surfaces via copper etching techniques and the connection of both ringelectrodes via the printing apertures are made by electroplating. As a result every single aperture has a ring electrode (106*a*) on one side of the isolating member, a ring electrode (106*b*) on the other side of the isolating member, and a through-hole connection (106*c*).

The ringelectrodes on both sides of the isolating member are connected via the connection through the apertures and via connecting lines to a single voltage source.

The electrodes on the isolating film can be made from any good electricity conducting material. From these materials metals, and especially copper, are preferred. The isolating film can also be any isolating material, e.g. porcelain, polymers, etc. A polyimide film is a preferred isolating material.

The printing apertures through the isolating material fan be made by any method known in the art, e.g. laser burning, plasma etching, etc. When the printing apertures are large enough, it is possible to make them by mechanical drilling.

It has proven to be benificial in terms of long term stability when, in a printhead structure according to the present invention, the printhead structure electrodes (106*a*), (106*b*) and (106*c*) are surface-treated with at least one thin layer coating (111) of abhesive material such as very thin coatings of TEFLON (trade name of Du Pont USA, polysiloxane resins, acrylic resins or epoxy resins. Also the use of thin very-hard layers (layers with very low scratchability), e.g. coatings of silicium carbide or nitride, or the like, is very useful. If necessary both kinds of layers can be present together.

The invention also provides a DEP device comprising a printhead structure as described hereinabove.

The invention further provides a DEP device (a device for direct electrostatic printing) comprising:

(i) a toner delivery means (101), (ii) a back electrode (105), (iii) a printhead structure (106), installed between a toner delivery means (101) and a image receiving substrate (109), characterised in that said printhead structure comprises:

(i) one individual control electrode (106*a*) around each aperture (107) on one side of said insulating material (106*d*) of said printhead structure, (ii) one individual shield electrode (106*b*) around each aperture (107) on the other side of said insulating material (106*d*) of said printhead structure, wherein each single electrode of said individual control electrodes (106*a*) and each single electrode of said individual shield electrodes (106*b*) arranged around each aperture (107) are connected to each other via metallisation (106*c*) through said single aperture (107), forming a single printing electrode around each aperture (107).

DESCRIPTION OF A DEP DEVICE

Figure 2:
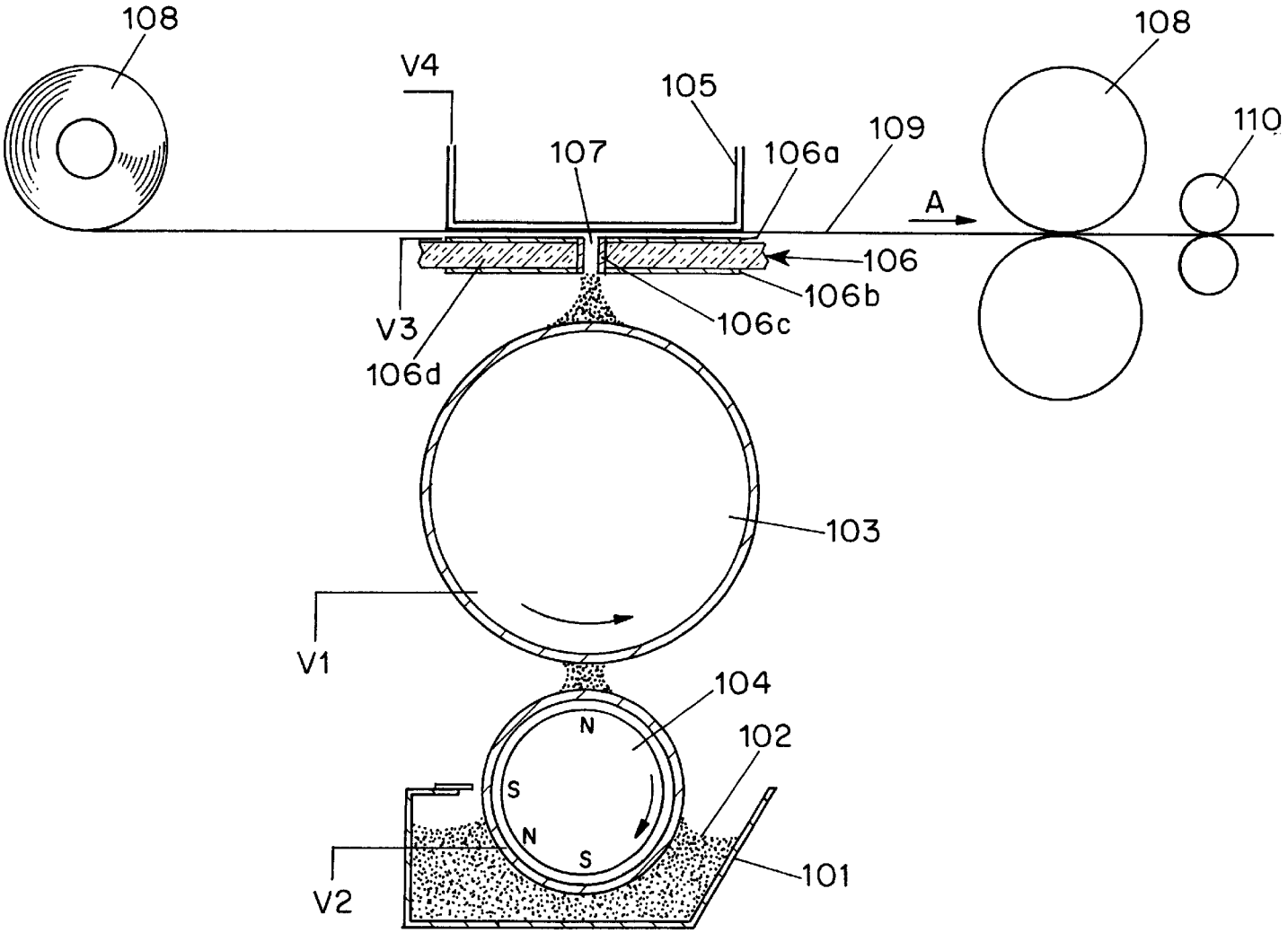
FIG. 2 is a schematic illustration of a possible embodiment of a DEP device incorporating a printhead structure according to the present invention.

An example of a device for implementing DEP, wherein a printhead structure according to the present invention can be used, is shown in FIG. 2. In the specific embodiment shown in FIG. 2, the DEP device comprises:

(i) a toner delivery means (101), comprising a container for multi component developer (102), comprising magnetic carrier particles and toner particles, and a magnetic brush assembly (104), this magnetic brush assembly forming a layer of charged toner particles upon the surface of a CTC (charged toner conveyor) (103), (ii) a back electrode (105), also used as support for the image receiving substrate (109) at a close distance from the printhead structure (106), (iii) conveyer means (108) for conveying image receiving substrate (109) between a printhead structure (106) and said back electrode (105) in the direction indicated by arrow A, (iv) means for fixing (110) said toner onto said image receiving substrate (109).

(v) a printhead structure (106), installed between a toner delivery means (101) and a image receiving substrate (109), wherein (106*a*) is the individual control electrode, (106*b*) is the individual shield electrode and (106*c*) is the conducting connection between the electrodes (106*a*) and (106*b*).

The toner particles are attracted to the image receiving substrate through printing apertures (107) from the CTC (103).

Although in FIG. 2 a preferred embodiment of a DEP device is shown, it is possible to realise a DEP device according to the present invention using different configurations of a printhead structure (106), according to the present invention. For instance, the apertures in the printhead structure can have a constant diameter, or can have a larger entry or exit diameter.

Different electrical fields can be created between the magnetic brush assembly (104), charged toner conveyor (103), printhead structure electrodes (106*a*), (106*b*), (106*c*) and the back electrode (105).

In a specific embodiment of a DEP device, according to the present invention, shown in FIG. 2, voltage $V_1$ is applied to the sleeve of the charged toner conveyor (103), voltage $V_2$ is applied to the sleeve of the magnetic brush (104), a voltage $V_3$, ranging from $V_{30}$ up to $V_{3n}$ to the individual printhead structure electrodes (106*a*), (106*b*) and (106*c*), and voltage $V_4$ is applied to the support for the image receiving substrate (or to the back electrode) behind the toner image receiving substrate. In this case the support for the image receiving member is also the back electrode. It is possible to operate a DEP device wherein the two functions, image receiving substrate and back electrode are separated. In that case, voltage $V_4$ is applied to the back electrode. Herein is $V_{30}$ the lowest voltage level applied to the printhead structure electrode, and $V_{3n}$ the highest voltage applied to said electrode. Usually a selected set of discrete voltage levels $V_{30}$, $V_{31}$, . . . can be applied to the printhead structure electrode. The value of the variable voltage $V_3$ is selected between the values $V_{30}$ and $V_{3n}$ from the set, according to the digital value of the image forming signals, representing the desired grey levels. Alternatively, the voltage can be modulated on a time basis according to the grey-level value.

It is possible to use a printhead structure according to to this invention, in a DEP device comprising a segment back electrode (105) as described in e.g. U.S. Pat. No. 5,036,341 and EP-A 708 386. The printhead structure of this invention can also be used with a single, not segmented back electrode, and also in DEP devices using a separate support for the image receiving member and a seperate back electrode.

It is possible to implement a DEP device, using a printhead structure according to the present invention, wherein the charged toner particles are not first brought from a magnetic brush (104) to a charged toner conveyer (103), but wherein the toner particles are directly extracted from magnetic brush (104). In such a DEP device said toner delivery means (101) comprises a container for multi component developer (102), comprising magnetic carrier particles and toner particles, and a magnetic brush assembly (104) providing charged toner particles that are directly attracted to said image receiving substrate (109), through said printing apertures (107) from said magnetic brush assembly (104).

Such a DEP device, extracting the toner particles directly from a magnetic brush has been described in e.g. Japanese Laid Open Publication 60/263962, U.S. Pat. No. 5,327,169 and European Application 95200603.9, filed on Mar. 14, 1995.

In a DEP device, using a printhead structure according to the present invention, said charged toner conveyor can be a moving belt or a fixed belt comprising an electrode structure generating a corresponding electrostatic travelling wave pattern for moving the toner particles.

When in a DEP device, with a printhead structure according to this invention, the charged toner particles are directly attracted to said image receiving substrate (109), through said printing apertures (107) from said magnetic brush assembly (104), said magnetic brush can be either of the type with stationary core and rotating sleeve or of the type with rotating core and rotating or stationary sleeve.

When said magnetic brush assembly, used in a DEP device wherein the toner particles are brought to a charged toner conveyer as well as in a DEP device wherein the toner is directly attrated from the magnetic brush, is of the stationary core/rotating sleeve type said magnetic carrier particles are soft magnetic particles exhibiting a coercivity of less than 250 Oe.

When said magnetic brush assembly, used in a DEP device wherein the toner particles are brought to a charged toner conveyer as well as in a DEP device wherein the toner is directly attrated from the magnetic brush, is of the rotating core/rotating sleeve type said magnetic carrier particles are hard magnetic particles exhibiting a coercivity of more than 250 Oe.

In the embodiment using a multi-component development system several types of carrier particles, such as described in the EP-A 675 417 can be used.

Also toner particles suitable for use in the present invention are described in the above mentioned EP-A 675 417. Very suitable toner particles, for use in combination with a printhead structure according to the present invention are toner particles, having a well defined degree of roundness. Such toner particles have been described in detail in EP-A 715 218, that is incorporated herein by reference.

The usefulness of a printhead structure, according to the present invention, is not restricted to DEP devices working with multi-component developer. A printhead structure according to the present invention is also useful in devices using magnetic mono-component toners, non magnetic mono-component toners, etc.

A DEP device making use of the above mentioned marking toner particles can be addressed in a way that enables it to give black and white. It can thus be operated in a "binary way", useful for black and white text and graphics and useful for classical bilevel halftoning to render continuous tone images.

A DEP device according to the present invention is especially suited for rendering an image with a plurality of grey levels. Grey level printing can be controlled by either an amplitude modulation of the voltage $V_3$ applied on the printhead structure electrode (106*a*), (106*b*) and (106*c*) or by a time modulation of $V_3$. By changing the duty cycle of the time modulation at a specific frequency, it is possible to print accurately fine differences in grey levels. It is also possible to control the grey level printing by a combination of an amplitude modulation and a time modulation of the voltage $V_3$, applied on the printhead structure electrode.

The combination of a high spatial resolution and of the multiple grey level capabilities, opens the way for multilevel halftoning techniques, such as e.g. described in the EP-A 634 862. This enables the DEP device, according to the present invention, to render high quality images.

It can be advantageous to combine a DEP device, according to the present invention, in one apparatus together with a classical electrographic or electrophotographic device, in which a latent electrostatic image on a charge retentive surface is developed by a suitable material to make the latent image visible. In such an apparatus, the DEP device according to the present invention and the classical electrographic device are two different printing devices. Both may print images with various grey levels and alphanumeric symbols and/or lines on one sheet or substrate. In such an apparatus the DEP device according to the present invention can be used to print fine tuned grey levels (e.g. pictures, photographs, medical images etc. that contain fine grey levels) and the classical electrographic device can be used to print alphanumeric symbols, line work etc. Such graphics do not need the fine tuning of grey levels. In such an apparatus—combining a DEP device, according to the invention with a classical electrographic device—the strengths of both printing methods are combined.

EXAMPLES

MEASUREMENT OF MINIMUM VOLTAGE $V_3$ AND LONG TERM STABILITY

A printout was made using different configurations of the printhead structure. The printing continued for 8 hours and after that period of printing the contamination of said printhead structure with toner particles was rated from unacceptable (1) to very good (5). The data are summarized in table 1. Rating 5 indicates that no toner particles are visible after said printing cycle on the front electrodes of said printhead structure, while rating 1 indicates that clogging of the apertures has completely blocked image density before the run could be finished. During printing voltage $V_3$, applied on the control electrodes was changed from 0 to −300 Volts. The density of the image at each of the voltages was determined. A low density at a low voltage implies that the closing and opening of the printing apertures can proceed with fairly low voltages, which is desirable in DEP devices as a small blocking voltage means inexpensive drivers and apparatus. The results are summarized in table 1.

The DEP Device Used Throughout the Examples

In each example the same DEP device, using the same toner particles and carrier particles were used. Only the printhead structure and the orientation thereof were changed.

The toner delivery means was a charged toner conveyor supplied with charged toner particles from a stationary core/rotating sleeve type magnetic brush. The development assembly comprised two mixing rods and one metering roller. One rod was used to transport the developer through the unit, the other one to mix toner with developer.

The magnetic brush assembly (104) was constituted of the so called magnetic roller, which in this case contained inside the roller assembly a stationary magnetic core, showing nine magnetic poles of 500 Gauss magnetic field intensity and with an open position to enable used developer to fall off from the magnetic roller. The magnetic roller contained also a sleeve, fitting around said stationary magnetic core, and giving to the magnetic brush assembly an overall diameter of 20 mm. The sleeve was made of stainless steel roughened with a fine grain to assist in transport (Ra=3 $\mu$m).

A scraper blade was used to force developer to leave the magnetic roller. And on the other side a doctoring blade was used to meter a small amount of developer onto the surface of said magnetic brush assembly. The sleeve was rotating at 100 rpm, the internal elements rotating at such a speed as to conform to a good internal transport within the development unit. The magnetic brush assembly (104) was connected to a DC-power supply with −200 V (this is the $V_2$, referred to hereinabove in the description of FIG. 2). Said magnetic brush was located at 650 micron from the surface of a teflon coated aluminium charged toner conveyor (103) with a diameter of 40 mm. The sleeve of said charged toner conveyor was connected to an AC power supply with a square wave oscillating field of 600 V at a frequency of 3.0 kHz with 10 V DC-offset (this 10 V DC are the $V_1$, referred to hereinabove in the description of FIG. 2).

The back electrode (105) was held at 600 V DC (this is $V_4$, referred to hereinabove in the description of FIG. 2).

A macroscopic "soft" ferrite carrier consisting of a MgZn-ferrite with average particle size 50 $\mu$m, a magnetisation at saturation of 29 emu/g was provided with a 1 $\mu$m thick acrylic coating. The material showed virtually no remanence.

The toner used for the experiment had the following composition: 97 parts of a co-polyester resin of fumaric acid and propoxylated bisphenol A, having an acid value of 18 and volume resistivity of $5.1\times10^{16}$ ω.cm was melt-blended for 30 minutes at 110° C. in a laboratory kneader with 3 parts of Cu-phthalocyanine pigment (Colour Index PB 15:3). A resistivity decreasing substance—having the following structural formula: $(CH_3)_3NC_{16}H_{33}Br$—was added in a quantity of 0.5% with respect to the binder. It was found that—by mixing with 5% of said ammonium salt—the volume resistivity of the applied binder resin was lowered to $5\times10^{14}$ ω.cm. This proves a high resistivity decreasing capacity (reduction factor: 100).

After cooling, the solidified mass was pulverized and milled using an ALPINE Fliessbettgegenstrahlmühle type 100AFG (tradename) and further classified using an ALPINE multiplex zig-zag classifier type 100MZR (tradename). The resulting particle size distribution of the separated toner, measured by Coulter Counter model Multisizer (tradename), was found to be 6.3 $\mu$m average by number and 8.2 $\mu$m average by volume. In order to improve the flowability of the toner mass, the toner particles were mix ed with 0.5% of hydrophobic colloidal silica particles (BET-value 130 $m^2/g$).

An electrostatographic developer was prepared by mixing said mixture of toner particles and colloidal silica in a 10% ratio by weight (w/w) with carrier particles.

The distance between the front side of the printhead structure (106) and the sleeve of the charged toner conveyor (103), was set at 400 $\mu$m. The distance between the surface of said charged toner conveyor (103) and the sleeve of the magnetic brush (104), was set at 650 $\mu$m. The distance between the support for the image receiving substrate (105) (in the example said support combines the supporting function with the function of back electrode) and the back side of the printhead structure (106) (i.e. control electrodes **(106*a*)**) was set to 150 $\mu$m and the paper travelled at 1 cm/sec.

EXAMPLE 1

A printhead structure (106) was made from a polyimide film of 50 $\mu$m thickness, double sided coated with a 8 $\mu$m thick copperfilm. The printhead structure (106) had a plurality of apertures. On the back side of the printhead structure, facing the image receiving substrate, a ring shaped control electrode **(106*a*) was arranged around each aperture. Each of said control electrodes was individually addressable from a high voltage power supply. On the front side of the printhead structure, facing the toner delivery means, each aperture had one individual shield electrode (106*b*), which was connected to the corresponding control electrode via through-hole metallizing (106*c*)**.

The individually addressable control and shield electrode structures were made by conventional techniques used in the micro-electronics industry, using fotoresist material, film exposure, and subsequent etching techniques. The apertures (107) were made by excimer laser burning. The connections **(106*c*) between electrodes (106*a*) and (106*b*) through the apertures (107) were made by electroless deposition of copper. The apertures (107) were 150 $\mu$m in diameter, being surrounded on both sides of the printhead structure by a circular electrode structure in the form of a ring with a diameter of 300 $\mu$m. The apertures were arranged (staggered) in such a way as to obtain a linear pitch of 200 $\mu$m. The individually connected shield electrodes (106*b*) and control electrodes (106*a*)** were connected to a power supply which was variable for each individual apertured electrode pair.

EXAMPLES 2–3

The same printhead structure as described in example 1 was used except that before printing a very thin coating of TEFLON (trade name) (#2) or an epoxy resin (#3) was sprayed over the electrodes on both sides of said printhead structure.

COMPARATIVE EXAMPLE 1–4

A printhead structure with the same layout as described in example 1 was used except that the number of electrode planes was changed. In comparative example 1 a "classical" printhead structure was made as described by Pressman: i.e. on the surface of said printhead structure facing the charged toner conveyor a common shield electrode (106*b*) was used, on the other side individually addressable control electrodes (106*a*) were used and no through-hole connection was applied. In comparative example 2 the same printhead structure as described in comparative example 1 was used except that the orientation was changed: i.e. the common shield electrode was facing the image receiving substrate instead of the charged toner conveyor.

In comparative examples 3 and 4 the same printhead structures as described in comparative examples 1 and 2 were used, except that the common shield electrode was not provided: i.e. only control electrodes were available on one side of the polyimide while no conductive layer was present at the other side of the printhead structure.

TABLE 1

| | Density at voltage $V_3$ | | | | | |
|---|---|---|---|---|---|---|
| Example N° | 0 | −100 | −150 | −200 | −300 | Clogging |
| E1 | 1.28 | 0.15 | 0.05 | 0.00 | 0.00 | 4 |
| E2 | 1.31 | 0.18 | 0.02 | 0.00 | 0.00 | 4 |
| E3 | 1.40 | 0.25 | 0.05 | 0.00 | 0.00 | 5 |
| CE1 | 1.01 | 0.76 | 0.58 | 0.31 | 0.09 | 2 |
| CE2 | 1.28 | 0.26 | 0.09 | 0.00 | 0.00 | 2 |
| CE3 | 1.46 | 0.88 | 0.29 | 0.13 | 0.01 | 2 |
| CE4 | 1.51 | 0.22 | 0.04 | 0.00 | 0.00 | 2 |

From the data in table 1 it is evident that only the printhead structures according to the present invention combine BOTH a low voltage for controlling the image density with an excellent long term stability without clogging the apertures.

Having described in detail preferred embodiments of the current invention, it will now be apparent to those skilled in the art that numerous modifications can be made therein without departing from the scope of the invention as defined in the following claims.

I claim:

1. A printhead structure for use in a direct electrostatic printing device, said printhead structure comprising:

an insulating material having a front side and a back side;

a plurality of front-to-back printing apertures formed through said insulating material;

a plurality of printing electrodes corresponding to said plurality of printing apertures for selectively controlling a flow of charged dry toner particles through said printing apertures, each of said printing electrodes comprising:

a first individual electrode disposed on said back side of said insulating material surrounding a corresponding one of said printing apertures, said first electrode being electrically isolated from all other electrodes on said back side of said insulating material;

a second individual electrode disposed on said front side of said insulating material surrounding said corresponding printing aperture, wherein only said second electrode surrounds said corresponding printing aperture on said front side of said insulating material and said second electrode is electrically isolated from all other electrodes on said front side of said insulating material; and a metallization structure formed through said corresponding printing aperture and electrically connecting said first electrode and said second electrode.

2. The printhead structure according to claim 1, further comprising at least one thin layer coating of low scratchability material on each of said printing electrodes.

3. The printhead structure according to claim 1, further comprising at least one thin layer coating of abhesive material on each of said printing electrodes.

4. A direct electrostatic printing device comprising:

means for delivering charged dry toner particles;

a back electrode positioned opposite said delivering means and being maintained at an electrical potential which attracts a flow of said charged dry toner particles from said delivering means;

an image receiving substrate located between said delivering means and said back electrode for receiving said flow of said charged dry toner particles; and a printhead structure for imagewise modulating said flow of said charged dry toner particles to said substrate, said printhead structure being located between said delivering means and said image receiving substrate, said printhead structure comprising:

an insulating material having a front side and a back side;

a plurality of front-to-back printing apertures formed through said insulating material;

a plurality of printing electrodes corresponding to said plurality of printing apertures for selectively controlling said flow of said charged dry toner particles through said printing apertures, each of said printing electrodes comprising:

a first individual electrode disposed on said back side of said insulating material surrounding a corresponding one of said printing apertures, said first electrode being electrically isolated from all other electrodes on said back side of said insulating material;

a second individual electrode disposed on said front side of said insulating material surrounding said corresponding printing aperture, wherein only said second electrode surrounds said corresponding printing aperture on said front side of said insulating material and said second electrode is electrically isolated from all other electrodes on said front side of said insulating material; and a metallization structure formed through said corresponding printing aperture and electrically connecting said first electrode and said second electrode.

5. The direct electrostatic printing device according to claim 4, further comprising at least one thin layer coating of low scratchability material on each of said printing electrodes.

6. The direct electrostatic printing device according to claim 4, further comprising at least one thin layer coating of abhesive material on each of said printing electrodes.

7. The direct electrostatic printing device according to claim 4, further comprising a voltage input signal representing image information.

8. The direct electrostatic printing device according to claim 7, wherein said voltage input signal is amplitude modulated.

9. The direct electrostatic printing device according to claim 7, wherein said voltage input signal time modulated.

10. The direct electrostatic printing device according to claim 4, wherein said means for delivering said charged dry toner particles comprises:

a multi-component developer comprising magnetic carrier particles and said charged dry toner particles;

a container for holding said multi-component developer;

a charged toner conveyor; and a magnetic brush assembly for attracting said charged dry toner particles contained in said multi-component developer and for forming a layer of said charged dry toner particles on said charged toner conveyor, whereby said charged dry toner particles are transported, through said printing apertures, from said charged toner conveyor to said image receiving substrate.

11. The direct electrostatic printing device according to claim 10, wherein said magnetic brush comprises a stationary mounted core and a sleeve rotatably mounted around said core and wherein said magnetic carrier particles are soft magnetic particles having a coercivity less than 250 Oe.

12. The direct electrostatic printing device according to claim 10, wherein said magnetic brush comprises a rotatable core, and a sleeve rotatably mounted around said core, and wherein said magnetic carrier particles are hard magnetic particles having a coercivity greater than 250 Oe.

13. The direct electrostatic printing device according to claim 4, wherein said means for delivering said charged dry toner particles comprises:

a multi-component developer comprising magnetic carrier particles and said charged dry toner particles;

a container for holding said multi-component developer; and a magnetic brush assembly for attracting said charged dry toner particles contained in said multi-component developer and for transporting said charged dry toner particles, through said printing apertures, directly from said magnetic brush assembly to said image receiving substrate.

14. The direct electrostatic printing device according to claim 13, wherein said magnetic brush comprises a stationary mounted core and a sleeve rotatably mounted around said core and wherein said magnetic carrier particles are soft magnetic particles having a coercivity less than 250 Oe.

15. The direct electrostatic printing device according to claim 13, wherein said magnetic brush comprises a rotatable core and a sleeve rotatably mounted around said core, and wherein and said magnetic carrier particles are hard magnetic particles having a coercivity greater than 250 Oe.

* * * * *

UNITED STATES PATENT AND TRADEMARK OFFICE

CERTIFICATE OF CORRECTION

PATENT NO. : 6,003,975
DATED : December 21, 1999
INVENTOR(S) : Guido Desie

It is certified that error appears in the above-identified patent and that said Letters Patent is hereby corrected as shown below:

Column 12,
Line 67, "signal time" should read -- signal is time --;

Column 13,
Line 5, "rrier" should read -- rier --;

Column 14,
Line 25, before "BRIEF DESCRIPTION OF THE DRAWINGS", insert:
-- The above objects are realized by providing a DEP printhead structure comprising: (1) an insulating material comprising a front side, a back side and plurality of front-to-back printing apertures for transporting a flow of charged dry toner particles through the insulating material; (2) a plurality of printing electrodes, an individual one of the printing electrodes, being arranged around each of the printing aperatures, each of the printing electrodes comprising (a) an individual control electrode on the back side of the Insulating material, (b) and individual shield electrode on the front side of the insulating material; and (c) a metallization structure formed through each of the printing apertures, the metallization structure connecting the control electrode and the shield electrode formed around each of the printing apertures. In another aspect of the present invention a DEP printing device is disclosed comprising: (1) means for delivering charged dry toner particles; (2) a back electrode, the back electrode and the means for delivering charged dry toner particles being maintained at different electrical potentials to create a flow of charged dry toner particles from the means for delivering charged dry toner particles towards the back electrode; (3) an image receiving substrate for receiving the flow of charged dry toner particles; (4) a printhead structure for imagewise modulating the flow of charged dry toner particles, the printhead structure being located between the means for delivering charged dry toner particles and the image receiving substrate, the image receiving substrate passing between the electrode and the printhead structure, the printhead structure comprising (1) an insulating material comprising a front side facing the means for delivering charged dry toner particles, a back side facing the back electrode, and a pluarality of front-to-back printing apertures for transporting the flow of charged dry toner particles through the insulating material; and

UNITED STATES PATENT AND TRADEMARK OFFICE

CERTIFICATE OF CORRECTION

PATENT NO. : 6,003,975
DATED : December 21, 1999
INVENTOR(S) : Guido Desie

It is certified that error appears in the above-identified patent and that said Letters Patent is hereby corrected as shown below:

(2) a plurality of printing electrodes, an individual one of the printing electrodes being arranged around each of the printing apertures, each of the printing electrodes comprising an individual control electrode on the back side of the insulating material, an individual shield electrode on the front side of the insulating material, and a metalliztion stucture formed through each of the printing apertures, the metallization structure connecting the control electrode and the shield electrode formed around each of the printing apertures. --;

Column 9,
Line 62, "ω.cm" should read -- Ω.cm --;

Column 10,
Line 3, "ω.cm" should read -- Ω.cm. --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*